US005752765A

United States Patent [19]

Liou

[11] Patent Number: 5,752,765

[45] Date of Patent: May 19, 1998

[54] STRUCTURE FOR AN ORNAMENTAL LAMP

[76] Inventor: Ching-Chong Liou, No. 4, Alley 16, Kuang-Hua S. St., Hsin-Chu City, Taiwan

[21] Appl. No.: 756,898

[22] Filed: Dec. 3, 1996

[51] Int. Cl.[6] ..... H04C 33/00

[52] U.S. Cl. ..... 362/226; 362/249; 362/806

[58] Field of Search ..... 362/226, 249, 362/252, 250, 806; 439/699.2, 619, 345

[56] References Cited

U.S. PATENT DOCUMENTS 4,679,126 7/1987 Van Sickler ..... 362/226

5,605,395 2/1997 Peng ..... 362/249

*Primary Examiner*—Y. My Quach

*Attorney, Agent, or Firm*—Bacon & Thomas

[57] ABSTRACT

An improved structure for an ornamental lamp, having an outer socket, a connection sleeve, a bulb, a fastening assembly, power wires and copper plates; the outer socket has a cylindrical socket hole in the upper end, and a rectangular plug slot in the lower part; a space between the lower cylinder and the rectangular plug slot is used for laying two power wires with copper plates; the power wires and the copper plates are mounted in positioning round holes and in the copper plate slots respectively. The fastening assembly and the power wires are plugged into the rectangular plug slot, and then the outer surface of the fastening assembly and the positioning slot side of the rectangular plug slot will be close contact each other; the power wires will be pushed into spaces between the positioning round holes of the fastening assembly and the curved surfaces of flanges in the outer socket. The socket hole on the outer socket is used of receiving a connection sleeve with a bulb in close contact so as to prevent rain water from infiltrating into the outer socket.

3 Claims, 3 Drawing Sheets

STRUCTURE FOR AN ORNAMENTAL LAMP

BACKGROUND OF THE INVENTION

1. Field of the Invention

This invention relates to an ornamental lamp, and particularly to an ornamental lamp structure which has the power wires and the socket fastened together firmly to prevent rain water from infiltrating therein.

2. Description of the Prior Art

In a conventional string of ornamental lamps for Christmas, the two copper wires of a bulb usually pass through the socket hole of the bulb socket, and then are bent along both sides of a sleeve member; a socket for receiving the sleeve member is furnished with two power wires attached with two copper plates respectively on the ends thereof; the two copper plates are fastened to the slots of the socket respectively. After a small bulb is plugged into the socket, the two bent copper wires will be in contact with the copper plates respectively; the sockets are then connected with a power wire into a string.

Each socket in the aforesaid string ornament has an opening end for power wires with copper plates to pass through; then, the copper plates are plugged in the copper plate slots respectively. In the opening end of the socket, the two power wires may come into contact if the copper plates are out of the slots thereof; further, rain water may infiltrate therein, and subject a user to an electric shock.

SUMMARY OF THE INVENTION

The prime object of the present invention is to provide a structure for an ornamental lamp, which comprises an outer socket, a connection sleeve, a bulb, a fastening assembly, power wires and copper plates; the outer socket has a cylindrical socket hole in the upper end thereof, and a rectangular plug slot in the lower part thereof; a space between the lower cylinder and the rectangular plug slot is used for laying two power wires with copper plates; the power wires and the copper plates are mounted in the positioning round holes and the copper plate slots respectively. The fastening assembly and the power wires are plugged into the rectangular plug slot, and then the outer surface of the fastening assembly and the positioning slot side of the rectangular plug slot will be in close contact each other; the power wires will be pushed into spaces between the positioning round holes of the fastening assembly and the curved surfaces of flanges in the outer socket. The socket hole on the outer socket is used for receiving a connection sleeve with a bulb in close contact manner so as to prevent rain water from infiltrating into the outer socket.

Another object of the present invention is to provide an improved structure for an ornamental lamp, in which the socket hole of the outer socket has a deep cylinder, of which the bottom is provided with a rectangular plug slot; between the bottom of the cylinder and the rectangular plug slot, there are shoulders on both sides thereof respectively. Between the cylindrical member of the fastening assembly and the rectangular plug member, there are shoulder parts on both sides thereof. After the fastening assembly is plugged into the rectangular plug slot of the outer socket, the shoulder parts of the fastening assembly will be in close contact with the shoulders of the outer socket respectively, i.e., the fastening assembly being firmly mounted into the rectangular plug slot of the outer socket.

Still another object of the present invention is to provide an improved structure for an ornamental lamp, in which the positioning round holes on both sides of the fastening assembly are furnished with semi-circular grooves respectively; the opening thereof is in a curved shape; after the power wires are embedded into the positioning round holes, the power wires will be retained in place without moving out so as to facilitate the fastening assembly to be plugged into the rectangular plug slot.

A further object of the present invention is to provide an improved structure for an ornamental lamp, in which the bottom of the rectangular plug slot in the outer socket is provided with two flanges on both sides thereof, and each of the flanges has a curved surface after the fastening assembly is plugged into the rectangular plug slot of the outer socket, the curved surfaces of the flanges on both sides in the plug slot and the two positioning round holes in the fastening assembly will form into spaces to hold the power wires in place firmly.

A still further object of the present invention is to provide an improved structure for an ornamental lamp, in which the fastening assembly is plugged into a space formed between the lower cylinder in the outer socket and the rectangular plug slot. The upper part of the fastening assembly has a cylindrical member. The cut on the upper part of the fastening assembly and the two copper plates form into a rectangular slot. A space formed with the rectangular slot and the upper cylinder of the outer socket is used for receiving the connection sleeve with a bulb; the two filaments on both sides of the connection sleeve will be in contact with the two copper plates on both sides of the fastening assembly respectively so as to supply power to the bulb.

DETAILED DESCRIPTION OF THE PREFERRED EMBODIMENT

Figure 1:
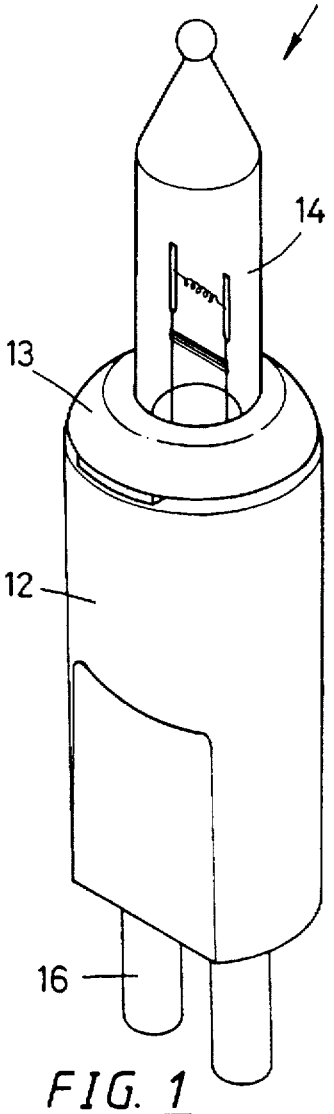
FIG. 1 is a perspective view of the present invention, showing the outer shape thereof.
Figure 2:
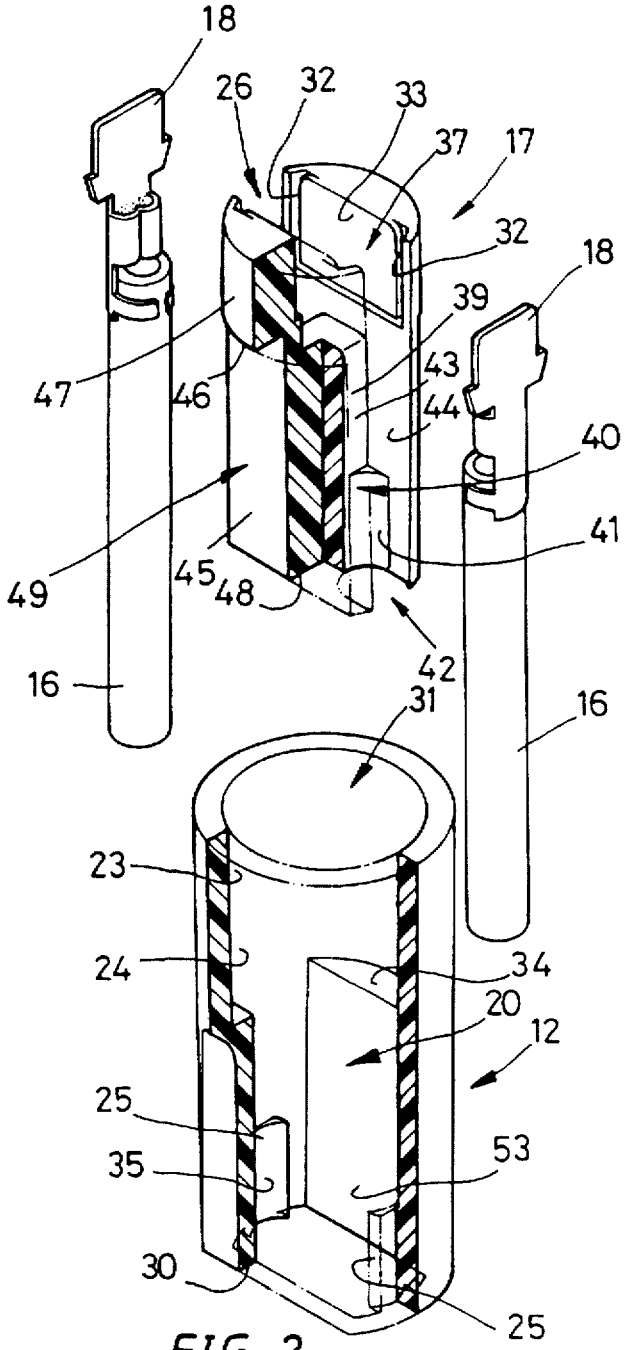
FIG. 2 is disassembled and perspective view of the present invention, showing the structure relation among assemblies thereof.
Figure 3:
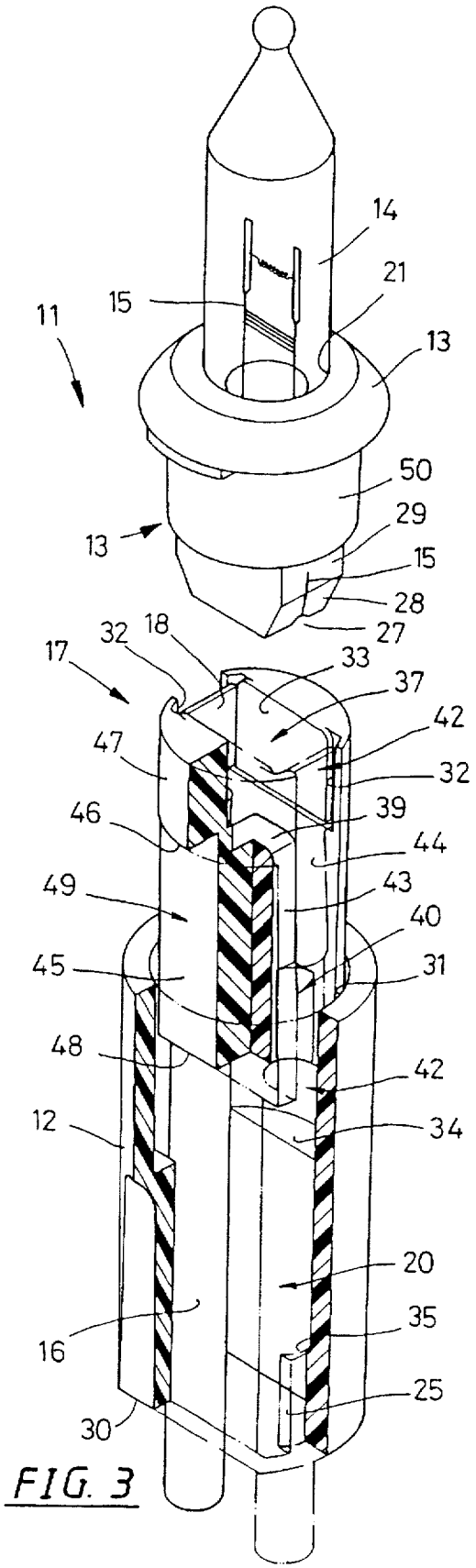
FIG. 3 is a sectional view of the present invention, showing the structure relation among assemblies thereof.
Figure 6:
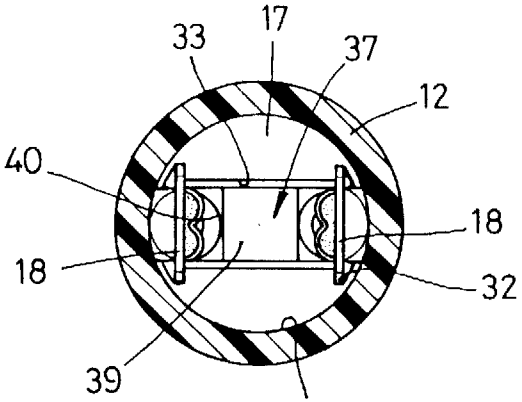
FIG. 6 is a sectional view of the present invention taken along line 6—6 as shown in FIG. 4.

Referring to FIGS. 1 to 3, the ornamental lamp 11 according to the present invention comprises an outer socket 12, a fastening assembly 17, a connection sleeve 13, a bulb 14, power wires 16 and copper plates 18. The upper end of the outer socket 12 has a socket hole 31, of which the bottom has a rectangular plug slot 20 for receiving the fastening assembly 17. A space between a lower cylinder 24 of the socket hole 31 and the rectangular plug slot 20 is used for receiving the fastening assembly 17 mounted with a pair of power wires 6 and copper plates 18. The end part 48 of the fastening assembly 17 and the opening 30 of the outer socket 12 are horizontally aligned; the power wires 16 are fitted and fixed in the positioning round holes 40 on both sides of the fastening assembly 17 so as to prevent rain water from infiltrating in through the bottom of the outer socket 12.

The inside of the upper end of the outer socket 12 is furnished with a longer socket hole 31, which includes an upper cylinder 23 and a lower cylinder 24; the bottom of the lower cylinder 24 is provided with shoulders 34 on both sides respectively immediately above the rectangular plug slot 20; the lower cylinder 24 is used for receiving the cylindrical member 47 of the fastening assembly 17. The rectangular plug slot 20 is used for receiving a plug member 49 of the fastening assembly 17; both sides of the bottom of the rectangular plug slot 20 are provided with flanges 25 respectively. The width of each flange 25 is equal to that of each positioning round hole 40 on both sides of the fastening assembly 17. The outer surface of the flange 25 is formed into a curved surface 35 with guide grooves on both sides thereof.

The fastening assembly 17 is to be plugged in a space between the lower cylinder 24 and the rectangular plug slot 20; the upper part of the assembly 17 is formed into a cylindrical member 47, while the lower part thereof is formed into a rectangular plug member 49. The top of the cylindrical member 47 has a lateral cut 26, of which both sides are furnished with symmetrical positioning planes 33 respectively; near the outer ends of the lateral cut 26, there are two pairs of symmetrical copper plate slots 32 for receiving the copper plates 18 mounted on ends of the two power wires respectively. Under the two pairs of copper plate slots 32, there is a flat surface 44; between the two copper plates 18, a rectangular slot 37 is formed. A partition plate 39 is furnished under the central part of the cut 26, and the partition plate 39 has a suitable thickness; both sides of the partition plate 39 are formed into flat surfaces 43 respectively. The slot opening 42 under the copper plate slots 32 extends down to the end part 48, and the inner edge of slot opening 42 is in contact with the flat surface 43 of the partition plate 39. Between the flat surface 44 and the flat surface 43, there is a curved surface 41 which extends upwards from the end part 48. The curved surface 41 and the flat surfaces near both sides thereof are formed into a positioning round hole 40 for receiving a power wire 16 upon the fastening assembly 17 with power wires 16 being plugged into the rectangular plug slot 20 in the outer socket 12. The curved slot openings 42 are used for allowing the power wires 16 embedded into the positioning round holes 40 after the copper plates 18 being plugged in place so as to have the fastening assembly 17 with power wires 16 mounted in the outer socket 12.

Referring to FIGS. 2 to 5, the outer and upper part of the fastening assembly 17 is formed into a cylindrical member 47; the diameter of the cylindrical member 47 is designed to fit the diameter of the lower cylinder 24 of the outer socket 12. The outer surface 45 of the rectangular plug member 49 of the fastening assembly 17 is so designed as to fit between the positioning slot sides 53 of the rectangular plug slot 20 in the outer socket 12. Two symmetrical shoulders 34 are furnished between the lower cylinder 24 and the rectangular plug slot 20; symmetrical shoulders 46 are provided between the cylindrical member 47 and the plug member 49. After the fastening assembly 17 is plugged into the rectangular plug slot 20, the lower cylinder 24 and the shoulders 34 can have the fastening assembly 17 fixed in place without rotation; then, the cylindrical member 47 of the fastening assembly 17 is fastened in the lower cylinder 24 in the outer socket 12. The outer surface 45 of the rectangular plug member 49 and the positioning slot side 53 of the rectangular plug slot 20 are in contact each other hermetically. The end part 48 of the plug member 49 and the opening 30 of the outer socket 12 are set on the same level.

Figure 7:
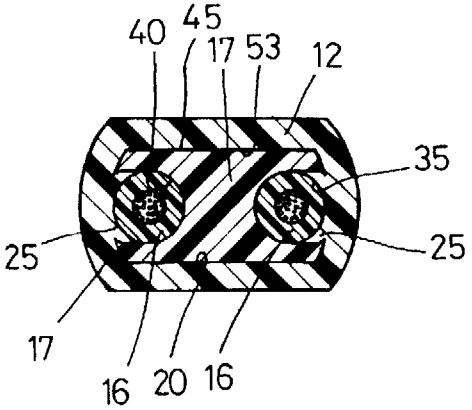
FIG. 7 is a sectional view of the present invention taken along line 7—7 as shown in FIG. 4.
Figure 5:
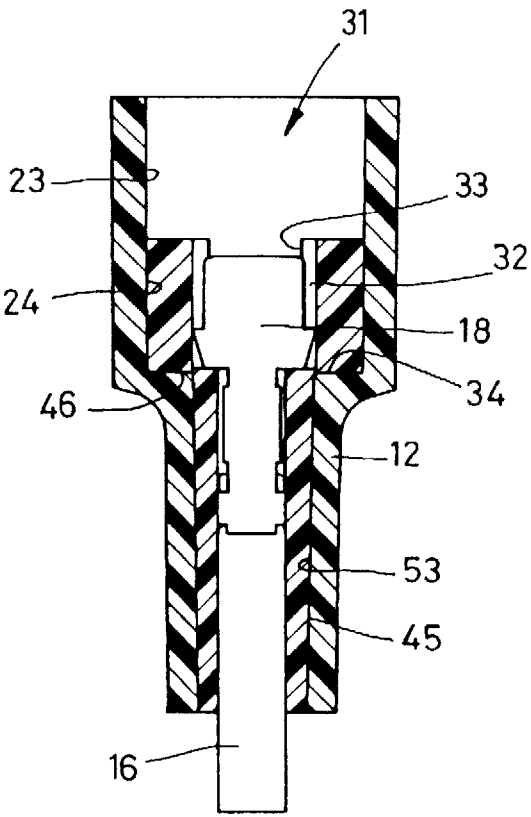
FIG. 5 is a sectional view of the present invention taken along line 5—5 as shown in FIG. 4.
Figure 4:
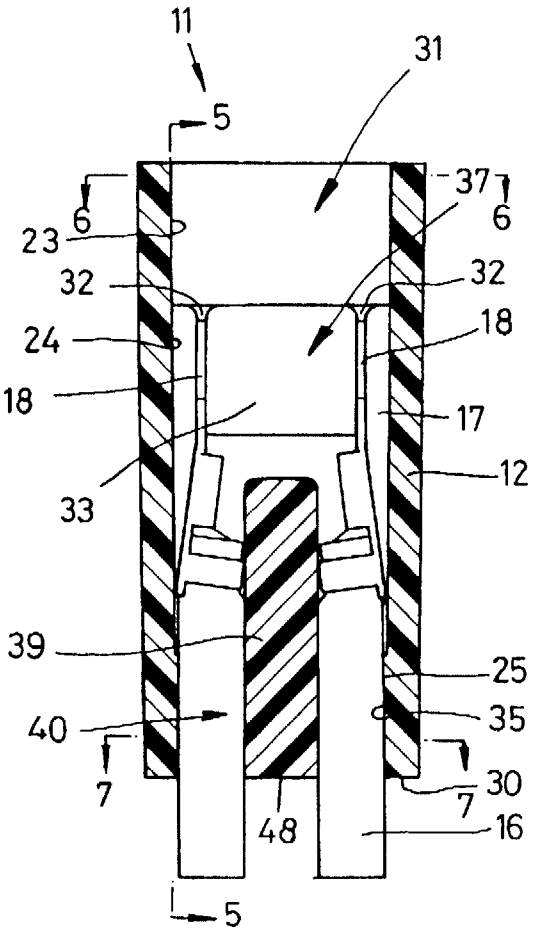
FIG. 4 is a sectional view of the present invention, showing the structure of the outer socket thereof.

Before the fastening assembly 17 is plugged into the outer socket 12, two power wires 16 attached with two copper plates 18 are laid through the bottom of the rectangular plug slot 20 in the outer socket 12 so as to have the two copper plates 18 embedded into the copper plate slots 32 in the fastening assembly 17 respectively; under each pair of copper plate slots 32, the lower end of the positioning round holes 40 has a curved slot opening 42 for receiving a power wire 16 so as to prevent the power wire 16 from moving out of the positioning round hole 40; when the power wires 16 are pushed into the positioning round holes 40, the power wires 16 will be in contact with the curved surfaces 41 in the positioning round holes 40; after the fastening assembly 17 is plugged into the outer socket 12, the flanges 25 and the curved surfaces 35 in the lower part of the rectangular plug slot 20 will be in contact with the slot openings 42 of the positioning round holes 40 in the fastening assembly 17; then, the power wires 16 in the positioning round holes 40 will be fastened in a space between the curved surfaces 41 and the flanges 25 with curved surfaces 35 (as shown in FIG. 7) without moving.

After the copper plates 18 are embedded into the copper plate slots 32 respectively, the power wires 16 can be pushed lightly into the positioning round holes 40 respectively. After the fastening assembly 17 is plugged into the rectangular plug slot 20, the power wires 16 may be pulled to have the fastening assembly 17 moved into the rectangular plug slot 20 completely; then, the outer surface 45 of the fastening assembly 17 will be in close contact with the positioning slot side 53 in the rectangular plug slot 20; in that case, the power wires 16 will be fixed in a space between the curved surfaces 41 and the flanges 25 with curved surfaces 35.

Referring to FIGS. 2 to 6, the fastening assembly 17 mounted with the power wires 16 and the copper plates 18 is to be plugged into the lower cylinder 24 and the rectangular plug slot 20; a rectangular slot 37 is formed into shape with the two positioning planes 33 and the two opposite copper plates 18; the connection sleeve 13 is to be plugged into a hole formed with the rectangular slot 37 and the upper cylinder 23 in the outer socket 12; a bulb 14 is to be plugged into a bulb socket 21 furnished in the center of the connection sleeve 13. The two filaments 15 of the bulb 15 extend to an end opening 27, and then are pulled outwards along bevel surfaces 28 and outer surfaces 29. As soon as the connection sleeve 13 is plugged into the socket hole 31 of the outer socket 12, the cylindrical member 50 and the lower rectangular member of the connection sleeve 13 will be mated with the upper cylinder 23 in the outer socket 12 and the rectangular slot 37 in the fastening assembly 17 respectively; then, the two filaments 15 on the two outer surfaces 29 will be in contact with the two copper plates 18 in the copper plate slots 32 respectively so as to supply electric power to the bulb 14.

The rectangular plug slot 20 is used for positioning the fastening assembly 17 and the power wires 16; the outer socket 12 and the fastening assembly 17 are in close contact with the surfaces thereof so as to provide a fastening force between the power wires 16 and the outer socket 12, and to prevent rain water from infiltrating therein. By means of the upper cylinder 23 in the socket hole 31 and the rectangular slot 37 in the fastening assembly 17, the connection sleeve 13 can be plugged in place in a hermetical contact so as to prevent rain water from infiltrating therein, and to avoid electric shock upon touching by a user.

The present invention has been described with the aforesaid embodiment to point out the features and structure thereof. It is apparent that the present invention has been improved, and is not anticipated by any person skilled in the art; the structure of the present invention is deemed unique.

I claim:

1. An improved structure for an ornamental lamp comprising: an outer socket having a socket hole in an upper part thereof, a bottom of said socket hole forming a rectangular plug slot with opposite sides of said rectangular plug slot each having a flange, each of said flanges having a curved surface, a top of said socket hole forming a cylinder with said cylinder and said rectangular plug slot forming a space for receiving a fastening assembly;

said fastening assembly located in said outer socket, the fastening assembly having an upper end formed into a cylindrical member, and a lower end formed into a rectangular plug member, a center of said cylindrical member having a lateral cut, of which opposite sides form positioning planes and two pairs of copper plate slots respectively, the fastening assembly having, under said two pairs of copper plate slots, two positioning recesses with a partition plate being set between said two positioning recesses, the recesses each receiving a flange of said outer socket;

two power wires each having a copper plate on an end thereof each of said copper plates mounted in one of said two pairs of copper plate slots to form, with said lateral, cut, a rectangular slot, said power wires passing through said positioning recesses of said fastening assembly whereby, after said fastening assembly is plugged into said outer socket, said power wires are embedded between said positioning recesses and said curved surfaces of said flanges; and, a connection sleeve having a bulb, an upper part of said connection sleeve having a cylindrical configuration, while a lower part thereof has a rectangular configuration plugged into said rectangular slot of said fastening assembly such that two filaments from said bulb are each in contact with one of said copper plates respectively on opposite sides of said rectangular slot.

2. The improved structure for an ornamental lamp as claimed in claim 1, wherein said outer socket further comprises shoulders located on both sides of said rectangular plug slot below said cylinder said cylinder being configured to receive said cylindrical member of said fastening assembly; said rectangular plug slot under said shoulders configured to hermetically receive said rectangular plug member.

3. The improved structure for an ornamental lamp as claimed in claim 1, wherein at least a portion of each of said recesses form a curved surface whereby said recesses curved surfaces and said curved flange surfaces form positioning round holes for said power wires.

* * * * *